United States Patent [19]

Brundiek et al.

[11] 4,432,500

[45] Feb. 21, 1984

[54] ROLL MILL FOR MILLING COAL

[75] Inventors: Horst Brundiek, Kaarst; Ludwig Werner, Düsseldorf, both of Fed. Rep. of Germany

[73] Assignee: Loesche GmbH, Düsseldorf, Fed. Rep. of Germany

[21] Appl. No.: 333,299

[22] Filed: Dec. 22, 1981

[30] Foreign Application Priority Data

Jan. 8, 1981 [DE] Fed. Rep. of Germany ..... 3100341

[51] Int. Cl.[3] ..... B02C 15/00

[52] U.S. Cl. ..... 241/57; 241/121; 241/285 B

[58] Field of Search ..... 241/107, 287, 117–122, 241/57, 285 R, 285 A, 285 B

[56] References Cited

U.S. PATENT DOCUMENTS 3,591,094 7/1971 Gauer ..... 241/121 X 4,000,860 1/1977 Gotham ..... 241/285 B X 4,339,086 7/1982 Brundiek ..... 241/121

FOREIGN PATENT DOCUMENTS 52-22160 2/1977 Japan ..... 241/121

*Primary Examiner*—Mark Rosenbaum

*Attorney, Agent, or Firm*—Holman & Stern

[57] ABSTRACT

A roll mill, more specially for coal, has a turning pan and a number of rolls running thereon for producing a milling effect. Each roll is supported on a rocker arm, able to be turned about a horizontal axis which is roughly tangential to the pan. The rocker arm and the roll on it are forced down against the pan by a hydraulic cylinder joined with a fork which, in turn, is joined with the rocker arm for turning it about the turnpin. The fork may be unjoined from the rocker arm for upkeep work on the roll. Each rocker arm has a gas-tight cover structure which is part of the casing of the mill.

7 Claims, 4 Drawing Figures

ROLL MILL FOR MILLING COAL

BACKGROUND OF THE INVENTION

1. Field of the Invention

The present invention relates to a roll mill, more specially for milling coal, with a gas-tight mill casing, a turning milling pan and a number of milling rolls, designed for rolling on the pan, each milling roll being joined with a rocker arm for turning about a rocker arm axis.

2. Description of the Prior Art

Such mills generally have a current of air or other gas, normally heated to be higher than the temperature of the outside air, moving through them. The air of the gas is used for drying the material to be milled and for transporting dust. The gas makes its way with a higher-than-atmospheric pressure, as produced by a separate blower, into the inlet or connection point of a gas space under the turning mill pan, which has a blade ring round it. Then the air or other gas makes its way through the blade ring round the pan into the milling or working space where it takes up milled material, drying it in suspension and then transporting the milled-up material to the classifier placed over the milling space.

Because many electricity works or power stations are being changed over at the present time from oil to coal, it has become necessary to make further modifications in the design of coal milling plants.

BRIEF SUMMARY OF THE INVENTION

General Outline of the Invention

One of the main ideas of the present invention is the development of roll mills with a gas-tight housing based on a modular system, this being done by designing every milling roll and the parts joined therewith as a unit which may be turned outwards away from the pan. A further important idea of the present invention is that of designing a roll mill so that it may be produced modularly with a different number of rolls without any great changes in the rolls with the parts used therewith and which are able to be turned outwards away from the pan, all such roll units being made with like parts. More specially the roll units grouped round the pan of the mill are placed on separate supports or tables. In this respect, one purpose of the invention is to be seen as being that of producing a gas-tight housing for the rocker arm of each roll and making such gas-tight housing part of the general casing of the mill, this being because run mills for use with coal are designed for use with "direct blow-in systems" using a hot air current, that is to say an air current which is at a higher temperature than the outside air and has a higher temperature than it.

For this reason, one important part of the invention is that the rocker arm of each roll is guided by a fork, one end of the fork being joined with a driving system for forcing the roll against the pan, and for lifting it, the fork being able to be unjoined from the arm, which is boxed in a cover which is made as part of the gas-tight casing of the mill. In the case of one form of the invention, each rocker arm of a milling roll and its fork are joined together lockingly as a functioning unit by bolts, while for upkeep work on the roll and parts joined with it, the bolts are taken out for unjoining the rocker arm from the fork so that only the rocker arm may be turned outwards, that is to say without the fork, for moving the mill roll out of the casing. As a further part of the invention, the gas-tight structure, boxing in the rocker arm, has a cover, which is able to be joined up with the rest of the gas-tight casing of the mill and whose lower part is curved for covering up the lower part of the rocker arm, the cover running as far as a collar placed on the turnpin of the roll. For producing a gas-tight seal on each side of the cover, there is a boxed-in space for guard or sweeping air placed round the turnpin of the rocker arm for producing a gas-tight sealing effect round the turnpin. In order to keep down the level of forces acting on the turnpin's bearings, it is best if the leverage of the force of the hydraulic cylinder, measured at its piston rod, to the force produced by the roll on the roll pan is between 50 and 150%. In order to make certain of a gas-tight effect safeguarding the inside parts, each rocker arm is made hollow and sweeping air is forced through it, such air being pumped in at any position outside the working space of the mill, and more specially at the end of the turnpin, so that the air makes its way into the rocker arm and through its spaces and into a ring-gap between the roll and a skirt placed round it, so that such air is blasted therebetween at a high speed into the milling space.

For the purpose of making a further development of a known design of a roll mill, each roll unit of the mill is placed on a support which may be lifted and moved to a different position.

The invention is an improvement in the art because each milling roll unit is a module produced so that the mill may be run with two, or if desired with more such rolls without making any great changes in structure in the mill system if it is to be used with two or more rolls. Along with this useful effect, the mill is completely gas-tight and this is true for further parts of it which are designed to let one or all of the rolls be turned outwards for upkeep purposes.

DESCRIPTION OF THE DRAWINGS

One preferred embodiment of the invention will be made clear in the following detailed description taken with reference to the accompanying drawings, wherein.

DETAILED DESCRIPTION

Figure 1:
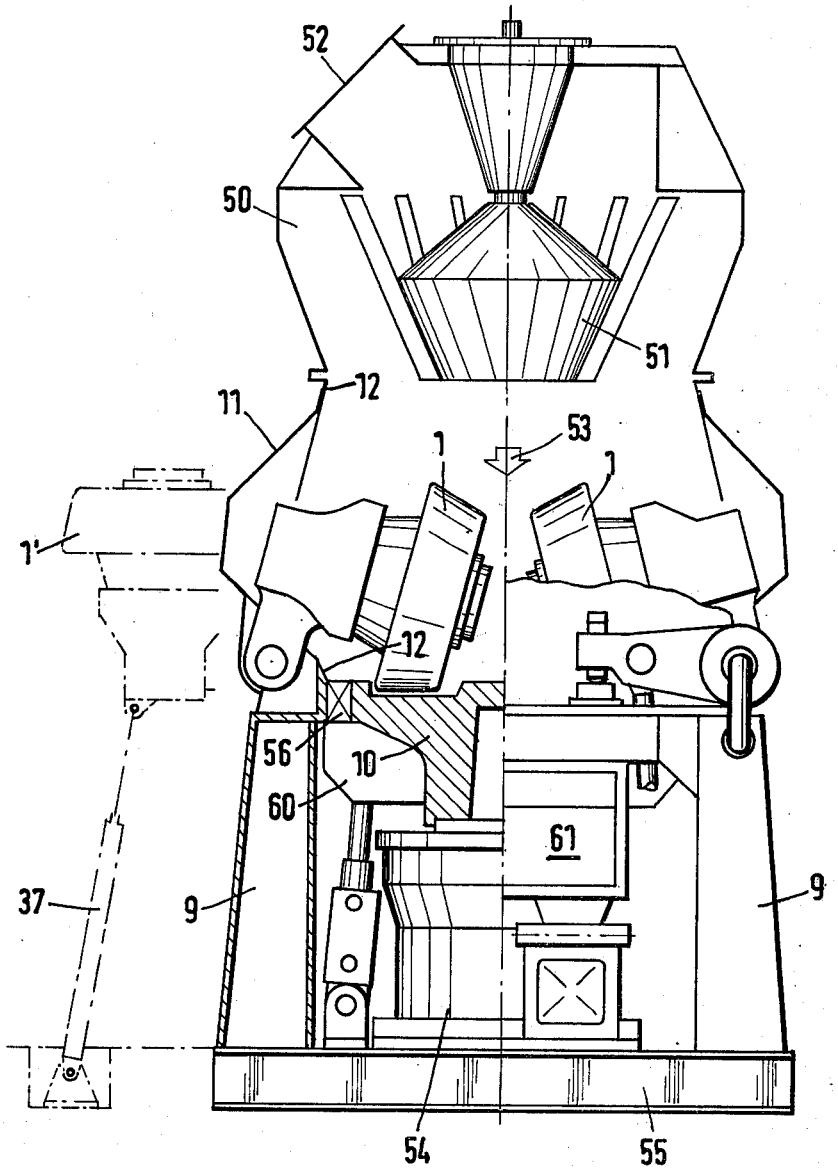
FIG. 1 is a diagrammatic elevational view, partly in section, of a roll mill to make clear its most important parts, but, however, without the structure of the present invention.

The known roll mill to be seen diagrammatically in FIG. 1 has two mill rolls 1 on upright tables or supports 9, of which there are a number placed round the mill pan 10. At the level of the rolls 1, the roll mill has a gas-tight casing 12, which has, for each roll 1, a cover 11, which may be taken off for upkeep work on the rolls as needed, the roll 1 then being rocked backwards out of the housing so that cover 11 and the roll go in to a position as shown on the left in broken lines. Over the gas-tight casing 12 a classifier housing 50 of a classifier 51 is placed. The outlet for hot air current from the mill casing is marked 52, arrow 53 for marking the direction of an input feed (unprocessed coal) into the mill. Hot air input is by way of a blade ring 56, which, in the present working example, is fixed to mill casing 12, although in point of fact other designs would be possible in which the blade ring 56 would be fixed to the mill pan 10. It will further be seen from the figure that a gearbox 54 is supported by a foundation 55 between upright tables 9.

Figure 2:
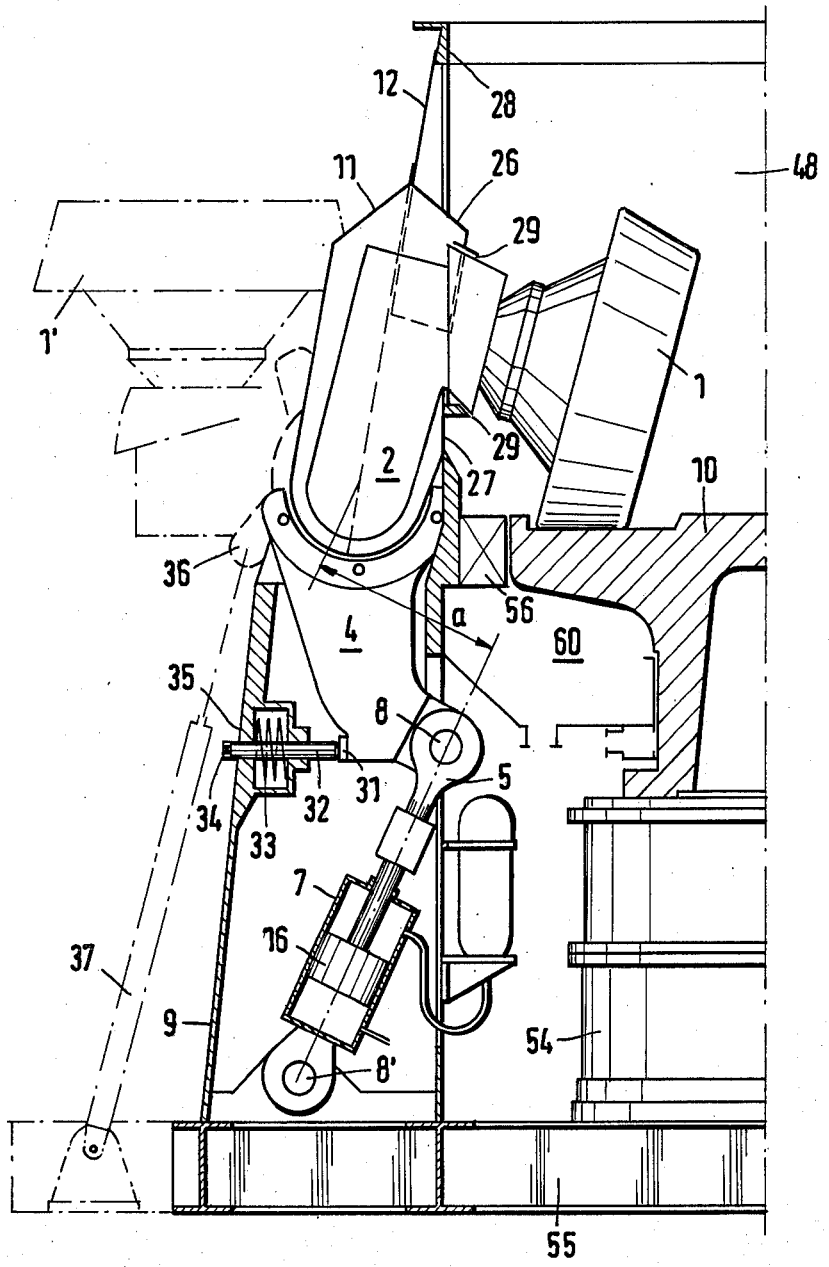
FIG. 2 is a cross-sectional, enlarged view of part of a mill roll showing its rocker arm, together with a fork, the milling pan and the hydraulic cylinder for acting on the fork in accordance with the invention.
Figure 3:
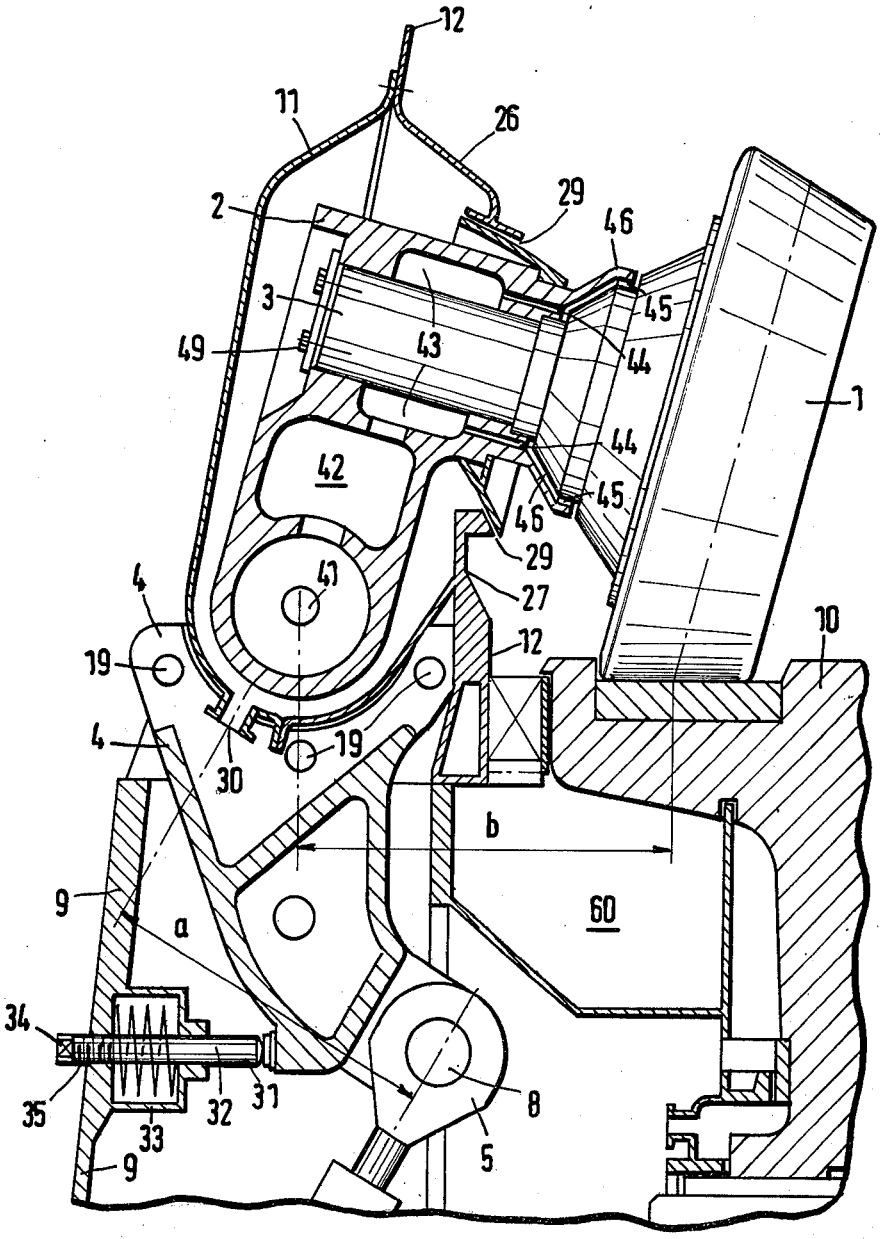
FIG. 3 is an enlarged cross-sectional view of part of the mill roll showing its rocker arm and further features of the invention.
Figure 4:
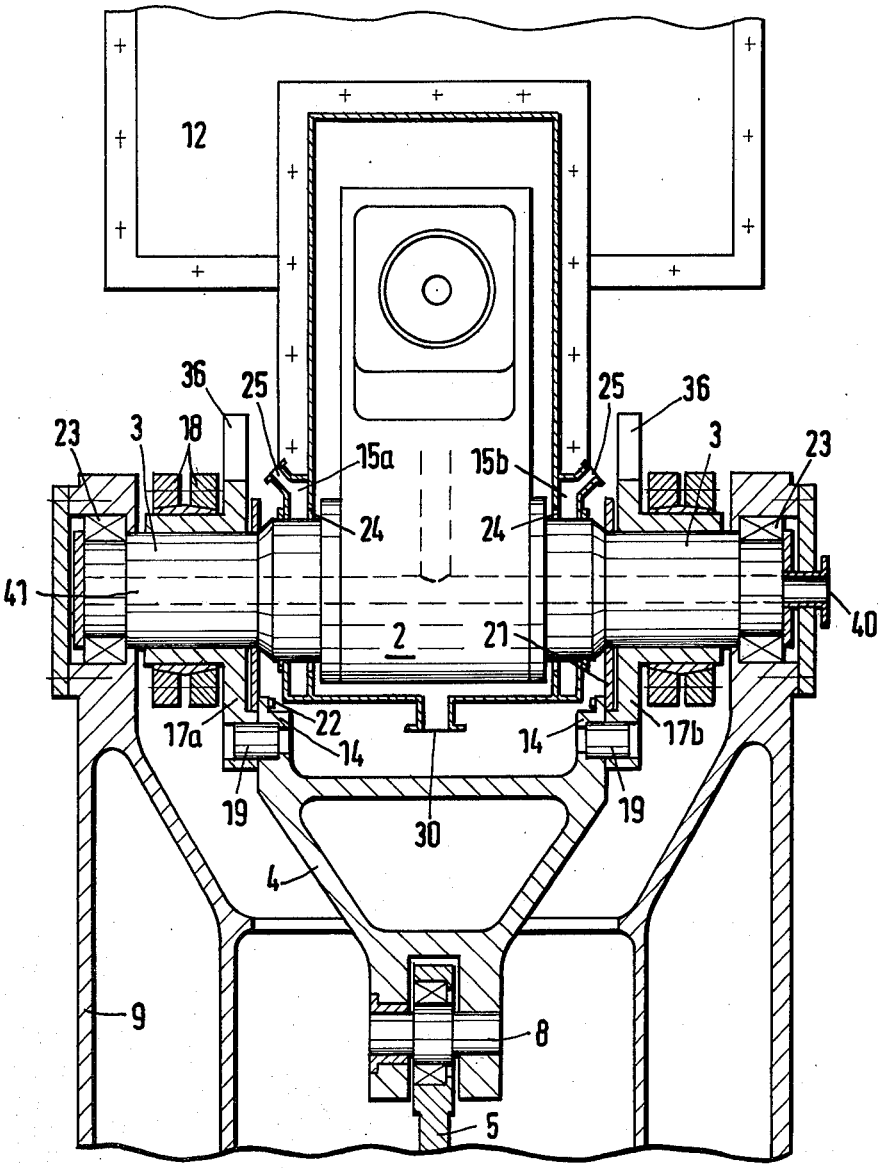
FIG. 4 is a diagrammatic cross-sectional view slowing the turnpin of the rocker arm with connections for sweeping or guard air.

FIG. 2 is a view of the important parts of the invention—such parts being seen, however, in more detail in FIGS. 3 and 4—from the side and in radial section. A mill roll 1 will be seen runningly resting on mill pan 10. Roll 1 may be rocked to the left and counter-clockwise into a roll-upkeep position 1' as shown in broken lines. The stub shaft of roll 1 is bearinged in rocker arm 2. Rocker arm 2 is encased within cover 11, which is gas-tight and is fixed to casing wall 12 so that it may be undone from it, the lower part of cover 11 being curved so as to be run round the lower part and lower end of rocker arm 2, such lower end of cover 11 resting against or being joined with wall 27 which is part of the mill casing 12 and not moved with the rocker arm 2. Between the inner edge of an opening in cover 26 and a sort of metal boot or skirt on rocker arm 2 there is a ring-space 29 or gap through which air may be blasted out of the space walled in by covers 11 and 26 and furthermore wall 27 and into the working space within the mill. Air in the covers 11, 26 is at a higher pressure than in the milling space within the mill. It is supplied into the space within the covers by way of pipe connection 30 (see FIG. 3).

This air is more specially taken from a wind chest or header 60 under blade ring 56, in which the air, heading for the space within the mill, is at a higher pressure than in the space because of the resistance of blade ring 56: that is to say no special separate blower is needed for forcing air into the space walled in by covers 11 and 26 together with wall 27 and out through ring-gap 29.

For upkeep operations, a backup cylinder 37 is used for turning the roll backwards (to the left) out of its working position and into an upkeep position as marked; such cylinder 37 may be taken away afterwards. It is joined up with eyes 36 (not to be seen in FIG. 3) on collars 17*a*, 17*b* on sleeves, on which further details will be given in connection with FIG. 4 later.

As will be seen from FIG. 2, the fork 4 is designed curving inwards somewhat towards the space under the pan 10 to be connected with a hydropneumatic cylinder 7 by a turnpin 8, which is slipped into an eyepiece 5 at the head of the piston rod of cylinder 7, whose lower end is turningly pinned at 8' to the foundation 55.

In FIG. 2, the reader will furthermore see a stop shoulder 31 for acting on a bolt 32 which, in turn, is acted on by a spring 33, the opposite, left hand end of the spring resting against a plate whose position may be changed horizontally by a nut-end 34 on a threaded tube taken up in a threaded hole in the support or table 9. In this way, adjustment of the position of pin 32 is made possible, pin 32 acting against shoulder 31 and, for this reason, on fork 4, arm 2 and roll 1 so as to keep roll 1 somewhat clear of pan 10 for the purpose of stopping metal-to-metal contact between pan 10 and roll 1.

Turning now to the section of FIG. 3 through the rocker arm 2 and the turnpin 3 supporting it and joined with the fork 4 thereunder, it will be noted that turnpin 3 is hollow, the hole in it being joined at the right hand end (FIG. 4) with a union 40, while halfway between the ends of turnpin 3 there is a branch radial hole running from the first-noted hole into a space (within rocker arm 2) 42, which is joined up with a further space 43 round the bearing unit of the roll's stub shaft. The space 43 is joined up by way of axial holes 44 with the narrow space 45 or gap between a bell-like outer face on the structure of roll 1 and a skirt 46 or bell placed around it. In operation, air is forced into hole 41 by way of union 40 to make its way into spaces 42, 43 and then by holes 44 into space 45, from which it is blasted into the working space in the mill for stopping dust such as coal dust working its way into the bearing unit of roll 1 and from damaging the same. For this reason, such air is named guard or sweeping air in the present specification.

The outer end of the roll's bearing unit is shut off by a cover plate kept in place by bolts 49.

Turning now to FIG. 4 it will be seen that for joining up the turnpin 3 with the fork 4, the sleeves, noted earlier, of collars 17*a*, 17*b*, are grippingly forced onto turnpin 3 by outer rings 18 with inner wedge-like faces resting on like faces on the skirts. The design is such that, by pulling together the two rings using bolts, the sleeves are forced strongly against the outer face of turnpin 3. The system is better than one using keys, because there are no parts acted on by shear forces, as would be the case with keys.

As will be seen from FIG. 3 there is furthermore a narrow gap 29 between the parts of the casing and a further skirt inside it, such parts of the casing being fixed to an inwardly running part of the mill casing 12.

Furthermore, in the present FIG. 3, the positioning of bolts 19 will be seen, such bolts fixing fork 4 on the rocker arm 2. In this respect, see the FIG. 4 as well. The bolts may be taken out for undoing rocker arm 2 from the fork 4. At the lower end of the figure, the reader will see the piston rod eyepiece 5 with the turnpin 8, noted earlier in connection with FIG. 2.

FIG. 4 furthermore gives details of the bearing and support system for the rocker arm 2 on turnpin 3. The last-named is supported on a table 9 or support, sectioned in the figure. As will be seen, fork 4 is curved so as to have an inwardly bent leg running into a position in a space almost under the mill pan 10. The two sides 14 of the fork will be seen to be so widely spaced from each other along the direction of the turnpin 3 as to take up the cover 11 (FIG. 3) with the two guard or sweeping air spaces 15*a* and 15*b* within it. The transmission of turning force from piston 16 (see FIG. 2) by way of eyepiece 5 or piston rod head and fork 4 to the turnpin 3 of the rocker arm 2 and the arm itself and then to the roll 1, is by way of collars 17*a* and 17*b* as noted. For keeping up the fork, that is to say stopping it from falling down, after undoing and taking out bolts 19 for upkeep operations, the two sides of fork 4 each have a sheet metal ring 21 fixed to them by screws 22, the design being such that on turning back the roll 1 for upkeep work into the position marked in chained lines in FIG. 2, there is a slipping motion of rings 21 in relation to turnpin 3 on which they and the fork 4 are kept up.

In connection with the use of a sweep or guard air current as noted, which is blasted through narrow gaps 29 between the roll support unit and its cover 11, 26, and through the gap 45 round the bell-like part of the roll, for the purpose of keeping out grains of coal or the like, the air inlet into the cover 11, is by way of unions 25 (see FIG. 4) on the two sides of the rocker arm 2 running into sweeping air spaces 15*a* and 15*b*, which are kept clear by such air, and by way of a union 30 at the lower end of the cover 11, 26, such air, by the nature of things, having a higher pressure than the air in the mill.

Rocker arm 2 on turnpin 3 is supported at its end by rolling element bearings 23. Collars 17*a*, 17*b* have eyepieces 36 (only to be seen in FIGS. 2 and 4) used for rocking back and lowering the roll unit into the broken-line position of FIG. 2 with the help of backup cylinder 37.

In one form of the invention, the distance (a) (see FIGS. 2 and 3) between the line of action of hydropneumatic cylinder 7 and the axis of turning of arm 2 is equal to between 50 and 95% of the distance (b), that is to say the distance between the said axis in the middle of the roll 1 as marked in broken lines in FIG. 3.

We claim:

1. In a roll mill having a gas-tight housing, a mill pan, a system for driving the pan about an upright axis, rolls designed for rolling and milling material on said pan supplied to said mill, and turnpins with rocker arms, equal in number to the number of rolls, each rocker arm turningly supporting one of said rolls, said arms being able to be rocked about axes of said turnpins, the improvement comprising said roll mill has a separate fork for each rocker arm, said fork being able to be undone from said rocker arm so that the arm may be moved separately from the fork, power means for acting on said rolls by way of said forks, and gas-tight covers placed around said rocker arms, said covers furthermore forming part of said mill housing.

2. A mill as claimed in claim 1, wherein each said rocker arm and said fork are lockingly joined together for operation of said mill as a single unit, said unit having bolts which may be taken out for unjoining said rocker arm from said fork so that a roll may be turned back clear of said pan for upkeep purposes, while said unjoined fork is kept in the same position.

3. A mill as claimed in claim 1, wherein each gas-tight cover has an outer part having a top part which may be joined up with and unjoined from the gas-tight mill housing and having a lower curved part placed round a lower end of said rocker arm, said rocker arm running outwards as far as a collar part of said turnpin.

4. A mill as claimed in claim 1, having a blade ring between an outer edge of said pan and said mill housing and a system for forcing an air current through said blade ring into a space over said pan, a connection with a space under said blade ring and with spaces within each of said covers and a space within each said rocker arm for guiding said air out into said mill housing through narrow gaps between at least one skirt placed around an outwardly turned part of said roll for blasting air through said gap, said blade ring causing said air to be at a higher pressure upstream thereof and downstream thereof in said mill housing.

5. A mill as claimed in claim 4, wherein each said turnpin is hollow and is joined with said space within such rocker arm, said turnpin having at one end thereof an air connection for forcing air into said turnpin, through said space in said arm and through a narrow gap round the outer face on said roll for blowing said gap clear of dust and stopping dust from making its way into said gas-tight cover.

6. A mill as claimed in claim 1, having guard air spaces formed at each side of said cover around said turnpin for producing a seal between said cover and said turnpin.

7. A mill as claimed in claim 1, wherein said power means comprises hydraulic cylinders each of which is joined with one of said forks, the lengths of the forks and the rocker arms being such that the leverage of the cylinder force measured in the length direction of the cylinder on the roll has a value between 50 and 150%.

* * * * *